US005775629A

United States Patent [19]

Cyr

[11] Patent Number: 5,775,629

[45] Date of Patent: Jul. 7, 1998

[54] NON-TWISTING TRANSFER TAIL SYSTEM

[75] Inventor: Gilles Cyr, Eugene, Oreg.

[73] Assignee: Industrial Adhesives, Inc., Eugene, Oreg.

[21] Appl. No.: 741,831

[22] Filed: Oct. 31, 1996

[51] Int. Cl.[6] ..... B65H 19/00

[52] U.S. Cl. ..... 242/551; 242/131; 242/556

[58] Field of Search ..... 242/551, 556, 242/131, 131.1

[56] References Cited

U.S. PATENT DOCUMENTS

| | | | |
|---|---|---|---|
| 1,850,071 | 3/1932 | Boyer | 242/556 |
| 2,361,857 | 10/1944 | McMullen | 242/556 |
| 3,741,079 | 6/1973 | Bosson et al. | 242/556 |
| 4,770,366 | 9/1988 | Hood et al. | 242/128 |
| 4,773,610 | 9/1988 | Nordlof | 242/78.6 |
| 4,812,198 | 3/1989 | Fuke et al. | 156/497 |
| 4,848,694 | 7/1989 | Julian | 242/78 |
| 4,984,750 | 1/1991 | Shigeta et al. | 242/58.1 |
| 5,029,768 | 7/1991 | Asbury et al. | 242/556 |
| 5,301,889 | 4/1994 | Ball | 242/55 |
| 5,474,208 | 12/1995 | Ball | 221/1 |
| 5,586,831 | 12/1996 | Tsubota et al. | 242/556 |

FOREIGN PATENT DOCUMENTS

| | | | |
|---|---|---|---|
| 4124022 | 1/1993 | Germany | 242/556 |

*Primary Examiner*—William Stryjewski
*Attorney, Agent, or Firm*—Chernoff, Vilhauer, McClung & Stenzel

[57] ABSTRACT

A non-twisting transfer tail system for interconnecting spools of tape includes a first, currently dispensing spool having a tail with a pivot, a second spool having a tape end, and a lead having a first end with an aperture connectable to the pivot and a second end connectable to the tape end. The first and second spools may having either an integral or an attachable tail as well as either an integral or an attachable lead. The tail may extend slightly beyond an edge of a tube core or may form a handle.

16 Claims, 2 Drawing Sheets

NON-TWISTING TRANSFER TAIL SYSTEM

BACKGROUND OF THE INVENTION

The present invention relates to a non-twisting transfer tail system for use in tape dispensers that both prevents the tape from twisting and provides an automatic transfer between spools of tape.

Tape, ribbon, and other flat, elongate material (referred to generally as "tape") is generally wound around a cylindrical core. The end of the tape adjacent the core is often prepared so that it extends beyond the core to form a transfer tail that provides an easily accessible connecting point for the succeeding spool. To transfer between two spools of tape, the tail of the first spool must be attached to the lead of the second spool.

Tape dispensers use either a manual or an automatic transfer technique to transfer between a first or currently dispensing spool and a second or succeeding spool. Manual techniques generally require that the packaging line be halted while the second spool is installed and the tape is threaded through the appropriate tape guides. Other manual techniques require a human operator to stand at the ready to manually splice the spools together while the machinery is slowed. As the manual techniques are costly because of human resources and time, an automatic solution is preferable.

U.S. Pat. No. 5,029,768 to Asbury, Jr. et al. discloses an automatic tape dispenser that includes an automatic tension control mechanism and has provisions for auto-splicing the tail of the first spool to the lead of the second spool. The problem with this automatic solution is that it does not provide a means for preventing the twisting of the tail. Accordingly, in the Asbury, Jr. et al. system, as the spools spin twists in the tape could be added between the first and second spools.

Although use of a transfer tail works well with spools that are stationary, it does not work well with spools that spin when they unwind. This is because if a transfer tail was tied to the lead of the next spool, the transfer tail would twist with every spin of the dispensing spool. If the tape becomes too twisted, it eventually breaks or jams.

What is needed, then, is a non-twisting transfer tail system that both prevents the tape from twisting and provides an automatic transfer between spools of tape.

BRIEF SUMMARY OF THE INVENTION

A non-twisting transfer tail system for interconnecting spools of tape includes a first, currently dispensing spool having a tail with a pivot, a second spool having a tape end, and a lead having a first end with an aperture connectable to the pivot and a second end connectable to the tape end.

The first and second spools may having either an integral or an attachable tail as well as either an integral or an attachable lead.

The tail may extend slightly beyond an edge of a tube core or may form a handle.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1B:
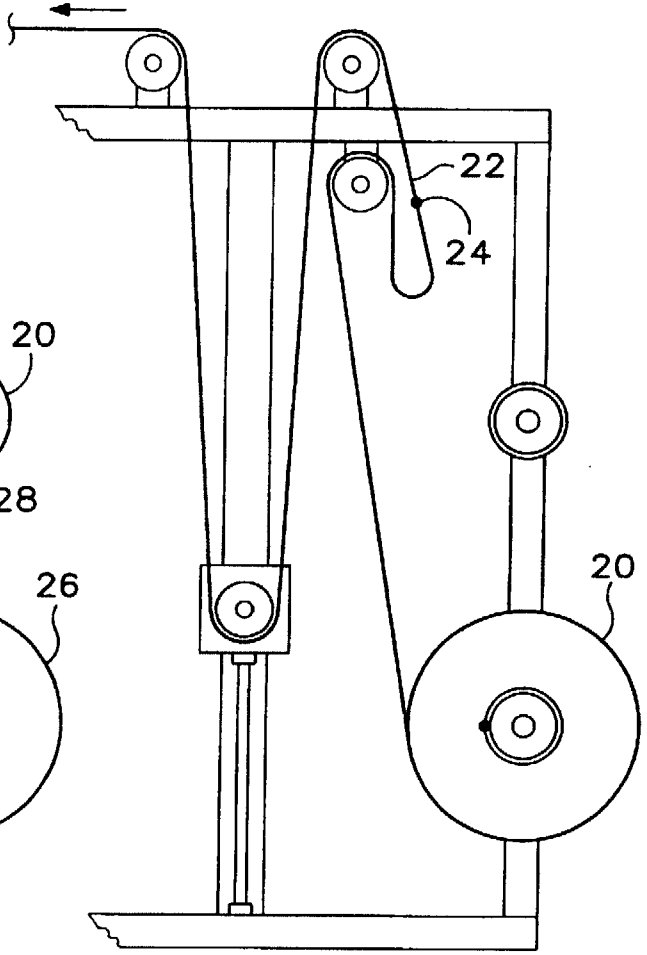
FIGS. 1*a* and 1*b* show a dispenser using the non-twisting transfer tail of the present invention before and after the transfer is made.
Figure 1A:
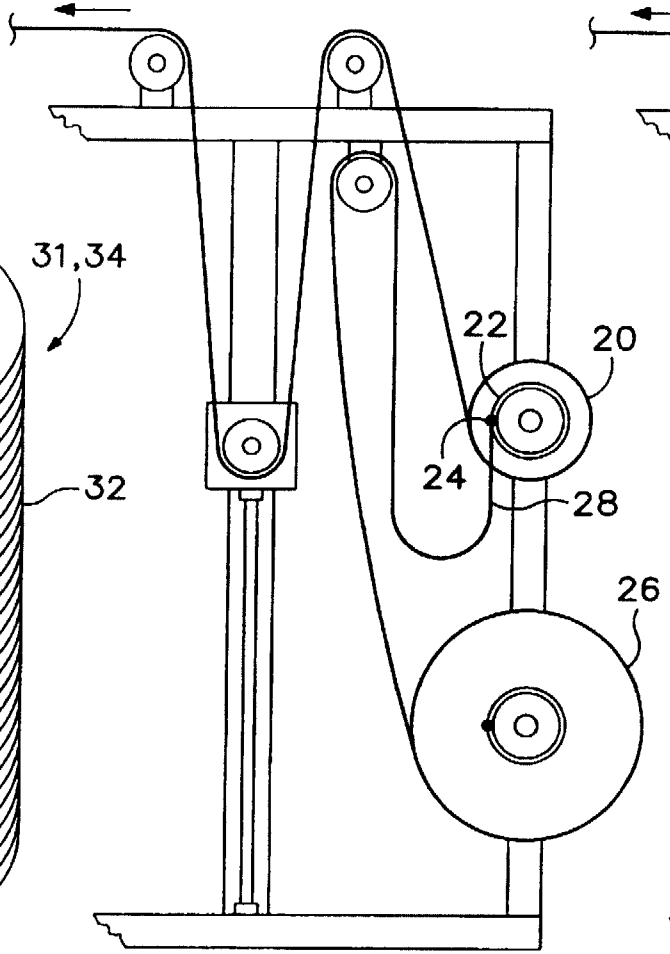

As shown in FIGS. 1*a* and 1*b*, the non-twisting transfer tail (NTTT) system of the present invention preferably includes a first, currently dispensing spool 20 of tape having a tail 22 with a pivot 24 and a second succeeding spool 26 having a tape end 27. The NTTT system also includes a lead 28 with an aperture 30 (FIGS. 2–4) that connects the first spool 20 to the second spool 26. Prior to the transfer, the tail 22 of the first spool 20 is attached to the lead 28 which, in turn, is attached to the second spool 26. When the first spool 20 runs out of tape, the second spool 26 automatically is pulled through the guides of a dispensing apparatus. At that point, as shown in FIG. 1*b*, the second spool 26 becomes the currently dispensing first spool 20.

The NTTT system works because it allows the first spool 20 to spin, while it is attached to the second spool 26, without the twisting the tail 22. This is accomplished by using a unique interconnection between the tail 22 of the first spool 20 and the lead 28. The unique interconnection consists of the aperture 30 being allowed to pivot freely around the pivot 24. Using this interconnection structure, as the first spool 20 twists, the aperture 30 pivots freely, thus preventing the tail 22 from twisting.

In FIG. 1*a* the first spool 20 spins as it unwinds. Since the pivot 24 of the tail 22 spins freely within the aperture 30 of the lead 28, the tail does not twist and yet it is attached to the lead 28. As shown in FIG. 1*b*, when the first dispensing spool 20 runs out of tape, the tail 22 remains connected to the lead 28. The tail 22 automatically pulls the lead 28 through the appropriate guides and the dispensing process continues uninterrupted. Using the NTTT system, the dispensing apparatus does not have to be stopped during this process of the spools being transferred. The second spool 26 can also be attached in a similar manner to the next spool (not shown).

Figure 2:
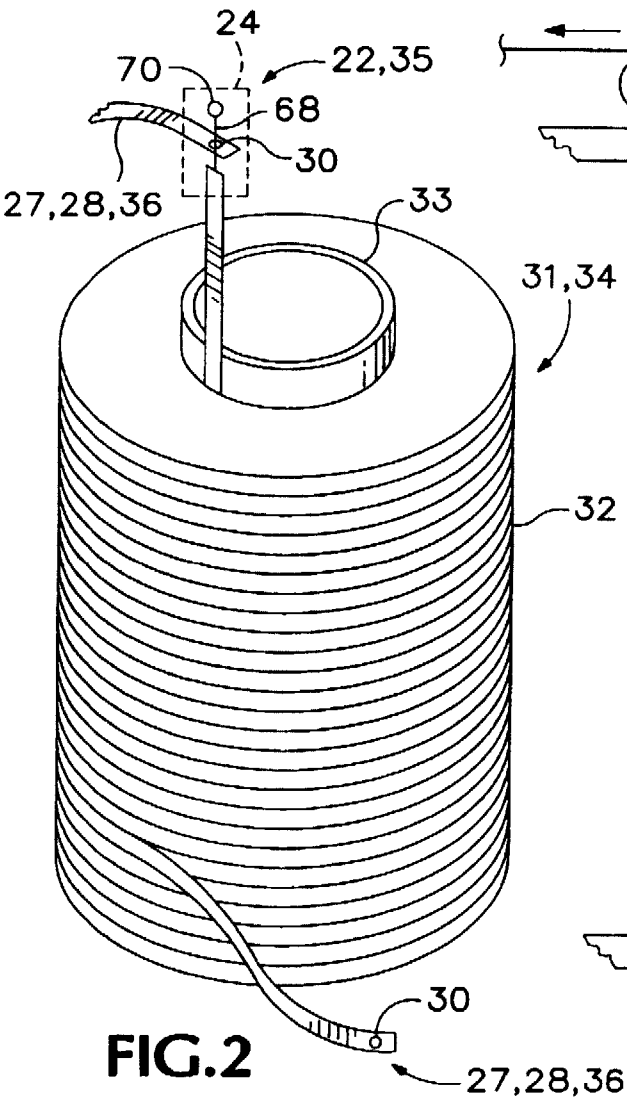
FIG. 2 is a spool of tape of the present invention having an integral tail and an integral lead.
Figure 4:
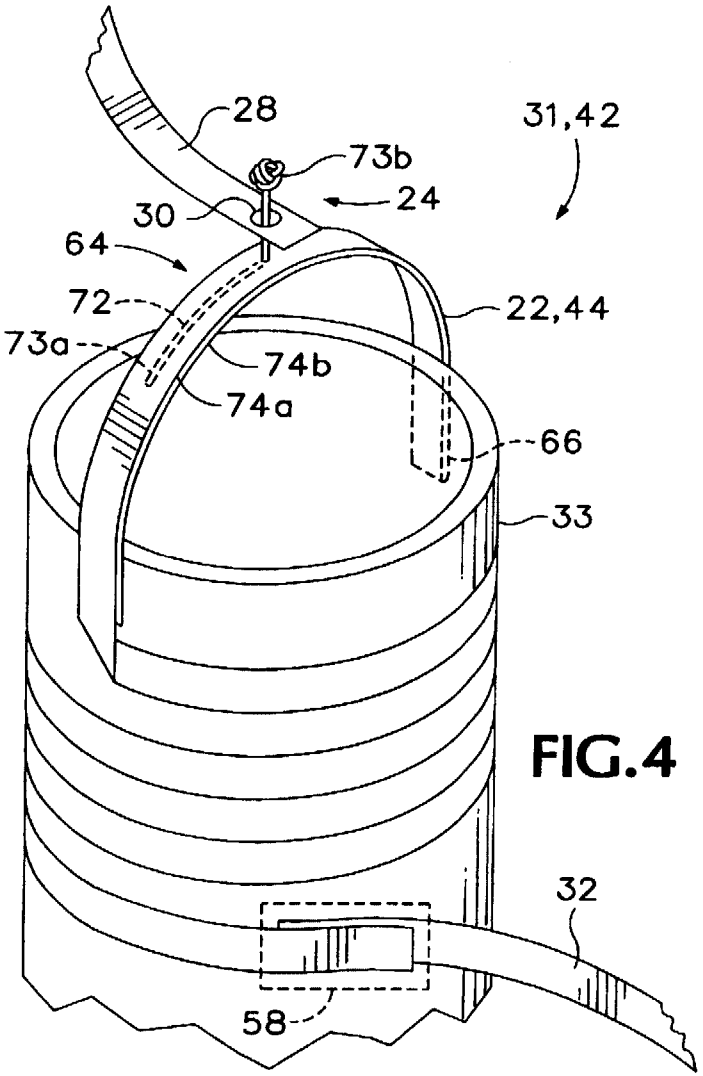
FIGS. 4 is a spool of tape of the present invention having an attachable tail that functions as a handle.
Figure 3:
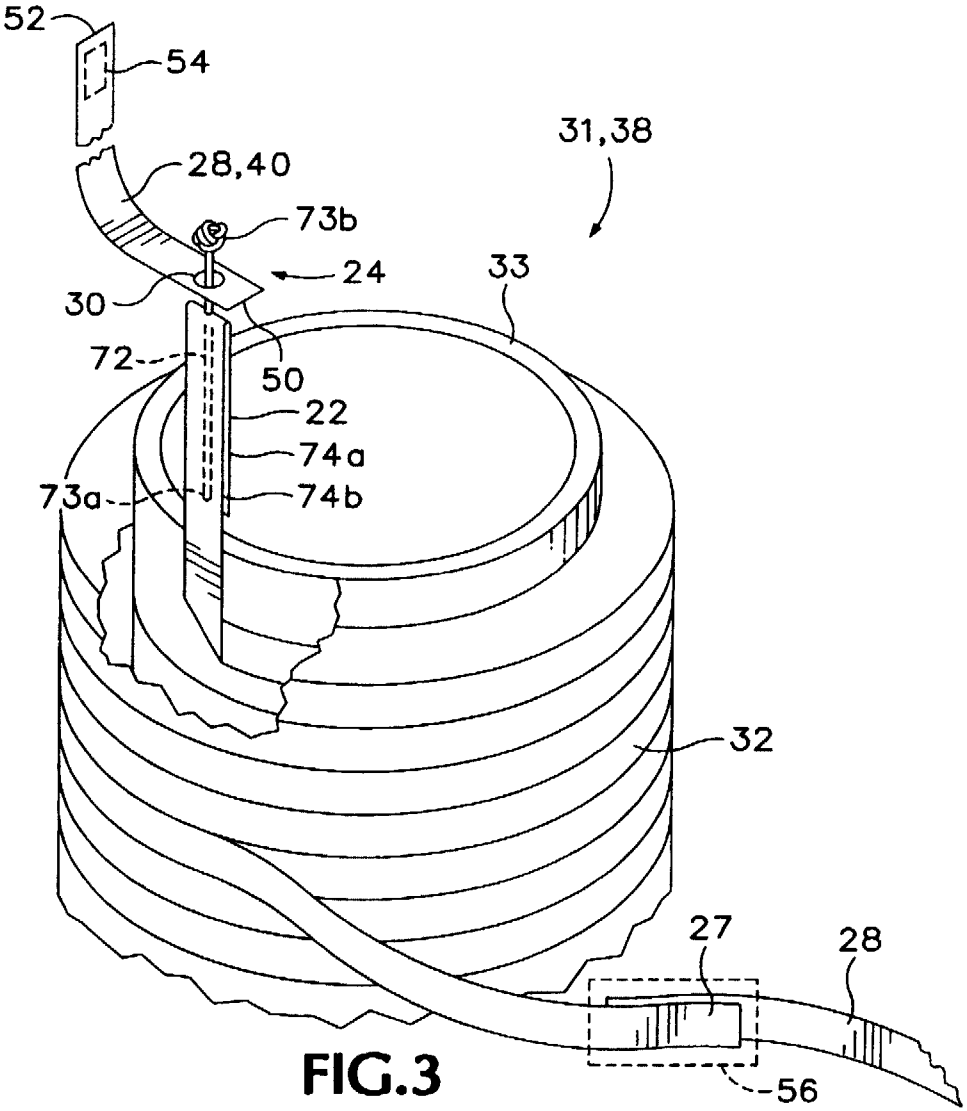
FIG. 3 is a spool of tape of the present invention having an integral tail and an attachable lead.

Since each spool can function as both a first spool 20 and a second spool 26 depending on the state of the dispensing apparatus, preferably each spool, generically referenced as 31, has both a tail 22 with a pivot 24 and a lead 28 with an aperture 30. Each spool 31 also includes a body of tape 32 that is wrapped around the core 33 to form the spool 31. FIG. 2 shows a spool 34 with an integral tail 35 and an integral lead 36. FIG. 3 shows a spool 38 with an attachable lead 40. FIG. 4 shows a spool 42 with an attachable tail 44. Each spool 34, 38, 42 could be either a first spool 20 or a second spool 26.

FIG. 2 shows a spool 34 with an integral tail 35 and an integral lead 36 that may be used in the NTTT transfer system. In this embodiment both the tail 35 and lead 36 are integral with the body of tape 32. In other words, in this embodiment, the integral tail 35 is formed, at least partially, from one end of the body of tape 32 and the integral lead 36 is constructed from the other, tape end 27 of the body of tape 32. To attach an integral tail 35 of a first spool 20 to an integral lead 36 of a second spool 26, the aperture 30 is slipped over the pivot 24 as the roll 34 is spinning.

FIG. 3 shows a spool 38 that uses an attachable lead 40. The attachable lead 40 may be a separate section of tape having a first end 50 with an aperture 30 and a second end 52 that may be attached to the tape end 27 of a succeeding spool. The second end 52 may include attachment apparatus 54 such as adhesive, or it may be attached using methods such as heat welding, heat sealing, tying, or other traditional attachment means.

An attachable lead 40 may be packaged as a completely separate piece from the spool 38. Alternatively, the attachable lead 40 may be packaged with the aperture 30 pivotably attached to the pivot 24 so that the second end 52 can be attached directly to the tape end 27 of the body of tape 32.

If the spool 34 was the first spool 20 in FIG. 1*a*, the attachable lead 40, if it was not already attached to the tail 22, could be attached to the tail 22 prior to being put on the dispensing apparatus. Then, while the spool 20, 34 was spinning, the attachable lead 40 could be attached to the tape end 27 using the attachment apparatus 54 or one of the methods described above at an attachment point 56.

FIG. 4 shows a spool 42 with an attachable tail 44 that is at least partially wound around the core 33 before being attached to the body of tape 32 at an attachment point 58. How the interconnection of a first spool 20 and a second spool 26 was executed would depend on whether the lead 28 was an integral lead 36 or an attachable lead 40. The specifics of the interconnection are discussed above in connection with FIG. 3.

It should be noted that a spool 31 of the present invention may have both an integral tail 35 and an integral lead 36 (FIG. 2), an integral tail 35 and an attachable lead 40 (FIG. 3), an attachable tail 44 and an integral lead 36, or an attachable tail 44 and an attachable lead 40.

The tails 22 of FIGS. 2 and 3 extend slightly beyond the edge of the tube core 33. In this embodiment the tail 22 may be tucked into the core 33 during shipping and storage. The pivot 24 in this embodiment would move in small circles as the spool 31 unwound. The aperture 30, once attached, would similarly move in small circles causing the lead 28 to follow.

FIG. 4 shows an alternate embodiment in which the tail 22 forms a handle 64. In this embodiment, the pivot 24 is centered in the middle of the tube core 33. In this central position the pivot 24 spins, but is otherwise relatively still. Since the pivot 24 spins freely within the aperture 30, the lead 28 is relatively still. To create the handle 64 a slightly longer tail 22 having a tail end 66 spans the core 33. The tail end 66 is placed against the core 33 and the body of tape 32 is wrapped around it to hold it in place. Before the body of tape 32 is wrapped around the tail end 66 it may be held in place by a piece of tape, light adhesive, or other known methods. When the tape unwinds completely, the tail end 66 is released from the core 33 and does not interfere with the operation of the NTTT system.

It should be noted that, although it is not shown, a handle 64 may be formed out of an attachable tail 44 (FIG. 4) or an integral tail. Similarly, an attachable tail may be constructed to extend slightly beyond the edge of the tube core 33 as shown in FIG. 3.

Turning specifically to the aperture 30, it may be any opening of sufficient size to permit smooth pivoting. As shown the aperture 30 is circular. Alternatively, the aperture 30 could be a button-hole-type slit that opens to allow the pivot 24 to pass partially through it. Another possibility is that the aperture 30 is a pear-shaped opening that has both a wide section that is wide enough to let the pivot 24 pass through it and also a narrow section in which the pivot 24 spins. The aperture 30 may also be reinforced to prevent tearing.

Turning specifically to the pivot 24, as shown in FIG. 2, the pivot 24 preferably consists of a narrow pivot portion 68 and a wide securing portion 70. The aperture 30 actually pivots around the narrow portion 68, but is prevented from escaping by the wide portion 70. The pivot 24 may take several forms. For example, the pivot 24 may be a knot in the tape itself, an end portion of tape that has a narrow portion created by twisting or binding, or an additional button-like apparatus added directly or indirectly to the end of the tape.

One type of pivot 24 is shown in FIGS. 3 and 4. This pivot uses a hot-melt coated string 72 that has one end **73*a* embedded between first and second layers of tape 74*a*, 74*b*. The second end 73*b* of the string 72 is knotted to form the wide portion 70 of the pivot 24**.

More specifically, as shown in FIG. 3, the string 72 may be extended through a small aperture (not shown) in the tail 22 of the tape. The tail 22 may be folded at the small aperture so that the first end **73*a* of the string 72 is embedded between the folded portions 74*a*, 74*b* of the tape. The pivot is then created by tying a knot in the second end 73*b*, melting the second end 73*b*, or adding a button-like apparatus to the second end 73*b***.

The pivot 24 shown in FIG. 4, like the pivot 24 discussed in connection with FIG. 3, also uses a string 72 that may be extended through a small aperture (not shown) in the tail 22 of the tape. However, because the tail 22 of FIG. 4 forms a handle 64, it must be longer and have a central pivot 24. Accordingly, the tail 22 is not folded at the small aperture through which the string 72 protrudes. Instead, the tail 22 is folded beyond the small aperture. The fold becomes the tail end 66. Otherwise, the string 72 is embedded between the folded portions **74*a*, 74*b* of the tape and the pivot 24** is created as discussed above in connection with FIG. 3.

Variations on the above described embodiments could be used in the NTTT system of the present invention. However, an exemplary NTTT system may use spools 31 having both an integral tail 35 that forms a handle 64 and an attachable lead 40. Each spool 31 could be shipped with the aperture 30 of the attachable lead 40 already connected to the string 72 that forms the pivot 24. The first spool 20 would be spinning with the pivot 24 centered so that it spins but otherwise is essentially still. The attachable lead 40 would hang free until it was to be attached to the second spool 26. The second end 52 of the attachable lead 40 of the first spool 20 could then be attached to the tape end 27 of the body of tape 32 of the second spool 26 using an attachment apparatus 54 or a known connection method. Because the aperture 30 would pivot freely on the pivot 24, the tail 22 would not twist. When the first spool 20 runs out of tape, the second spool 26 would be automatically attached.

It should be noted that although the invention has been described in terms of tape, any narrow band material may be used in place of the tape. For example, ribbon, string, fabric strips, and elastic bands are foreseen as possible alternatives to tape.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A non-twisting tape transfer system for interconnecting spools of tape, said system comprising:

(a) a first, currently dispensing spool having a tail, said tail having a pivot;

(b) a second spool having a tape end; and (c) a lead having a first end connectable to said pivot and a second end connectable to said tape end, said first end of said lead defining an aperture.

2. The system of claim 1 wherein said tail is integral with said first spool.

3. The system of claim 1 wherein said tail is attachable to said first spool.

4. The system of claim 1 wherein said lead is attachable to said tape end of said second spool.

5. The system of claim 1 wherein said tail extends slightly beyond an edge of a tube core centrally located within said first spool.

6. The system of claim 1 wherein said pivot has a narrow pivot portion and a wide securing portion.

7. The system of claim 1 wherein said pivot is a knot in said tail.

8. The system of claim 1 wherein said tail includes a string embedded between first and second layers of tape.

9. The system of claim 8 wherein said pivot is a knot in said string.

10. A method for transferring tape between a first currently dispensing spinning tape spool and a second succeeding tape spool, said first spool having a tail and said second spool having a tape end, said method comprising:

(a) dispensing tape from said first spool;

(b) providing a pivot on the tail of said first spool;

(c) providing a lead having a first end with an aperture connectable to said pivot and a second end connectable to said tape end;

(d) connecting said pivot and said aperture; and (e) connecting said second end to said tape end.

11. A non-twisting tape transfer system for interconnecting spools of tape, said system comprising:

(a) a first, currently dispensing spool having a tail, said tail having a pivot knot therein;

(b) a second spool having a tape end; and (c) a lead having a first end connectable to said pivot knot and a second end connectable to said tape end, said first end of said lead defining an aperture.

12. The system of claim 11 wherein said tail includes a string embedded between first and second layers of tape.

13. The system of claim 11 wherein said pivot is a knot in said string.

14. A non-twisting tape transfer system for interconnecting spools of tape, said system comprising:

(a) a first, currently dispensing spool having a tail, said tail having a pivot;

(b) a second spool having a tape end; and (c) a lead having a first end connectable to said pivot and a second end integral with said tape end, said first end of said lead defining an aperture.

15. A non-twisting tape transfer system for interconnecting spools of tape, said system comprising:

(a) a first, currently dispensing spool having a tail, said tail having a tail end;

(b) said first spool wrapped around a tube core;

(c) said tail end held against said tube core and said tail spanning said tube core to form a handle;

(d) said handle having a pivot;

(e) a second spool having a tape end; and (f) a lead having a first end connectable to said pivot and a second end connectable to said tape end, said first end of said lead defining an aperture.

16. The system of claim 15 wherein said handle has a middle point, and said pivot is positioned at said middle point.

* * * * *